US011429038B2

(12) United States Patent
Tanaka et al.

(10) Patent No.: US 11,429,038 B2
(45) Date of Patent: Aug. 30, 2022

(54) REPLACEABLE TONER CARTRIDGE WITH INLET PORT FOR RECYCLED TONER

(71) Applicant: Hewlett-Packard Development Company, L.P., Spring, TX (US)

(72) Inventors: Kenji Tanaka, Yokohama (JP); Takahiko Kimura, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/299,120

(22) PCT Filed: Jul. 16, 2020

(86) PCT No.: PCT/US2020/042342
§ 371 (c)(1),
(2) Date: Jun. 2, 2021

(87) PCT Pub. No.: WO2021/016038
PCT Pub. Date: Jan. 28, 2021

(65) Prior Publication Data

US 2022/0137533 A1 May 5, 2022

(30) Foreign Application Priority Data

Jul. 23, 2019 (JP) ..... JP2019-135393

(51) Int. Cl.
*G03G 15/08* (2006.01)
*G03G 21/12* (2006.01)

(52) U.S. Cl.
CPC ..... *G03G 15/0877* (2013.01); *G03G 15/0867* (2013.01); *G03G 21/12* (2013.01)

(58) Field of Classification Search
CPC ..... G03G 15/0867; G03G 15/0875; G03G 15/0877; G03G 21/10; G03G 21/105; G03G 21/12
See application file for complete search history.

(56) References Cited

U.S. PATENT DOCUMENTS

| | | | | |
|---|---|---|---|---|
| 6,625,414 | B2 | 9/2003 | Izumi | |
| 8,577,226 | B2 * | 11/2013 | Ozaki | G03G 15/0886 399/262 |
| 9,141,029 | B2 | 9/2015 | Kim et al. | |
| 9,454,125 | B1 | 9/2016 | Bejat et al. | |
| 10,126,705 | B1 | 11/2018 | Piening et al. | |
| 2004/0114944 | A1 | 6/2004 | Urabe | |
| 2015/0003870 | A1 * | 1/2015 | Murata | G03G 15/0865 399/120 |
| 2018/0217552 | A1 * | 8/2018 | Kitamura | G03G 15/0875 |

FOREIGN PATENT DOCUMENTS

| | | |
|---|---|---|
| EP | 0650103 A1 | 4/1995 |
| JP | 1994175493 | 6/1994 |
| JP | 2000089368 | 3/2000 |

* cited by examiner

*Primary Examiner* — Hoang X Ngo
(74) *Attorney, Agent, or Firm* — Staas & Halsey LLP

(57) ABSTRACT

A toner cartridge for an imaging apparatus includes a housing to accommodate toner, and an inlet port and an outlet port formed in the housing. The outlet port supplies the toner to a developing device of the imaging apparatus. The inlet port receives a residual toner removed from an image carrier of the developing device as a recycled toner.

15 Claims, 10 Drawing Sheets

REPLACEABLE TONER CARTRIDGE WITH INLET PORT FOR RECYCLED TONER

BACKGROUND

In some imaging systems, untransferred toner particles remaining on an image carrier without having been transferred to a sheet, is collected as a recycled toner. For example, the collected recycled toner may be mixed with an unused fresh toner supplied from a toner cartridge in a mixing device and may then be supplied to a developing device.

DETAILED DESCRIPTION

In the following description, with reference to the drawings, the same reference numbers are assigned to the same components or to similar components having the same function, and overlapping description is omitted. An imaging system may be an imaging apparatus such as a laser printer according to some examples, or a device within an imaging apparatus such as a developing device according to other examples.

Figure 1:
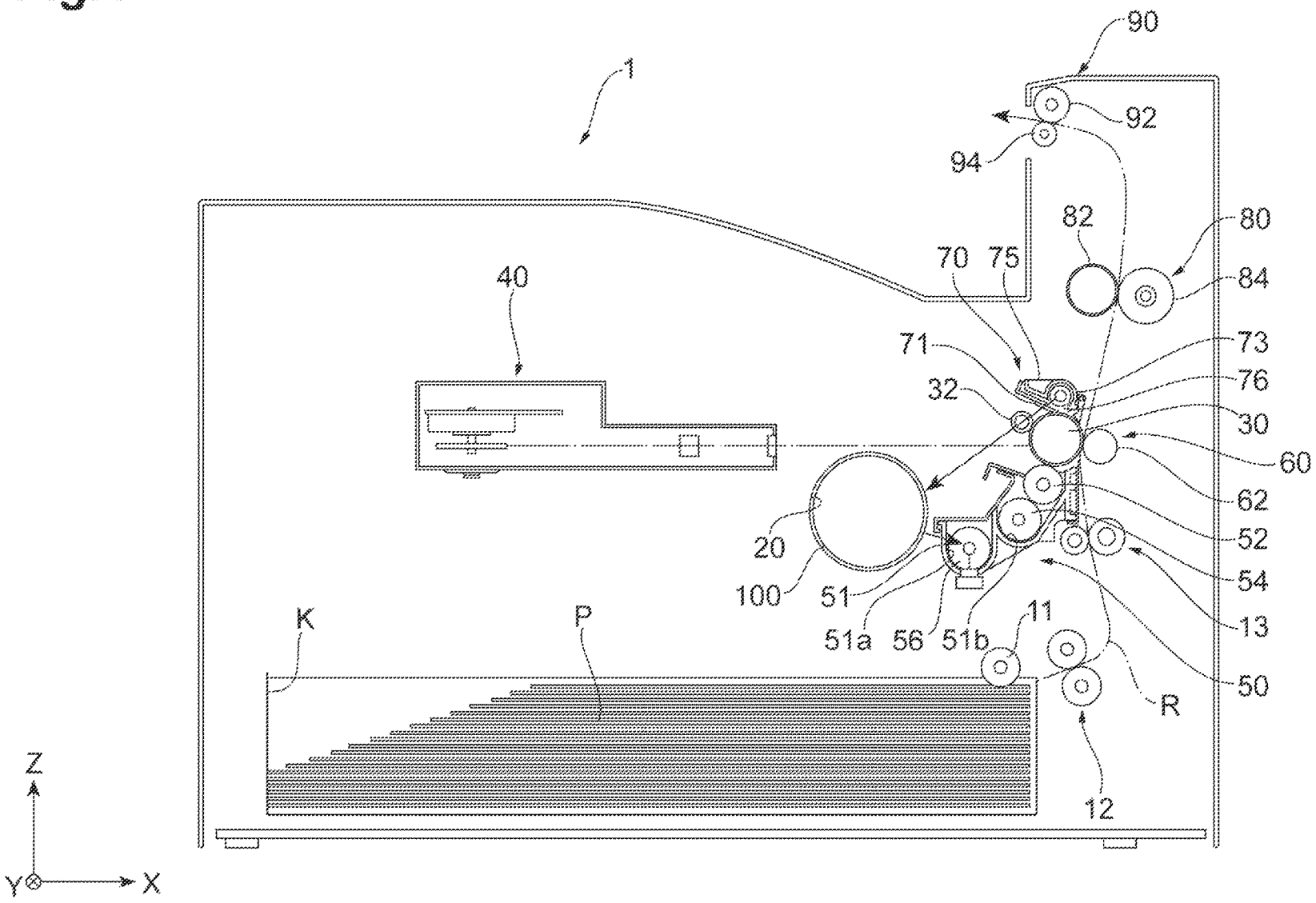
FIG. 1 is a schematic diagram of an example imaging apparatus of an example.

With reference to FIG. 1, the example imaging apparatus 1 includes a conveying device 10, a cartridge compartment 20, an image carrier 30, an exposure device 40, a developing device 50, a transfer device 60, a cleaning device 70, a fixing device 80, and a discharge device 90.

The conveying device 10 conveys a sheet P which is a recording medium having an image formed thereon on a conveying route R. The conveying device 10 of an example includes a pickup roller 11, a separation roller 12, and a registration roller 13 on the conveying route R. In an example, the sheets P are accommodated in a cassette K in a stacked state. The sheets P are picked up by the pickup roller 11 and are conveyed to the conveying route R. The sheets P conveyed to the conveying route R are separated into one sheet by the separation roller 12. The separated sheet P is conveyed to a transfer region which will be described further below, at a predetermined timing by the registration roller 13.

The cartridge compartment 20 accommodates an example toner cartridge 100. The example cartridge compartment 20 rotatably supports the accommodated example toner cartridge 100. The cartridge compartment 20 may include a driving device for rotating the accommodated toner cartridge 100. The example toner cartridge 100 is formed in a substantially cylindrical shape which extends in a longitudinal direction. Accordingly, the cartridge compartment 20 may be formed in a substantially cylindrical shape. In the example illustrated in FIG. 1, the longitudinal direction of the cartridge compartment 20 corresponds to the direction of the Y-axis of the XYZ Cartesian coordinate system (or the Y direction).

The image carrier 34 may include an electrostatic latent image carrier, a photosensitive drum, or the like. The image carrier 30 is formed in a columnar shape extending in an axial direction in the Y direction. The image carrier 30 has a circumferential surface to form an electrostatic latent image. A charging roller 32 located adjacent the image carrier 30, uniformly charges the surface of the image carrier 30 to a predetermined potential. The charging roller 32 can rotate in accordance with the rotation of the image carrier 30.

The exposure device 40 exposes the surface of the image carrier 30 charged by the charging roller 32 in response to the image to be formed on the sheet P. Accordingly, a potential of a portion exposed by the exposure device 40 in the circumferential surface of the image carrier 30 changes so that an electrostatic latent image is formed on the circumferential surface of the image carrier 30. In some examples, the exposure device 40 emits a laser beam on the circumferential surface of the image carrier 30, for example, by reflecting a laser beam output from a laser beam source using a polygonal mirror.

The developing device 50 develops the electrostatic latent image formed on the surface of the image carrier 30 by the toner supplied from the toner cartridge 100 so that a toner image is generated on the surface of the image carrier 30. The developing device 50 of an example includes a developing roller 52, a supply auger (screw conveyor) 54, and a mixing auger (screw conveyor) 56.

The developing roller 52, the supply auger 54, and the mixing auger 56 are accommodated in a casing 51. The casing 51 is provided with a conveying path 51*a* in which the mixing auger 56 is disposed and a conveying path 51*b* in which the supply auger 54 is disposed. The developing roller 52 is disposed at a position higher than the supply auger 54 with respect to the conveying path 51*b*. A part of the developing roller 52 in the circumferential direction is exposed from the casing 51. The developing roller 52, the supply auger 54, and the mixing auger 56 are rotationally driven by a driving device which responds to a control signal from a control device.

The mixing auger 56, the supply auger 54, and the developing roller 52 extend substantially parallel to each other, each having a parallel axis which defines an axial direction. The casing 51 may be filled with a developer containing a carrier and a toner. The mixing auger 56 conveys a developer in the conveying path 51*a* along the axial direction while mixing the developer. The developer which is conveyed to one end of the mixing auger 56 is conveyed to the conveying path 51*b* adjacent to the conveying path 51*a* by a predetermined mechanism. The supply auger 54 conveys a developer in the conveying path 51*b* in the axial direction. The developer conveyed through the conveying path 51*b* is picked up by the developing roller 52. The toner contained in the picked-up developer is supplied to the electrostatic latent image on the image carrier 30.

In some examples, the developing device 50 is provided with a sensor which measures toner concentration in the developer. For example, when it is determined via the sensor, that the toner concentration has decreased, the control device controls the toner cartridge 100 so that the toner is supplied to the developing device 50.

The transfer device 60 includes a transfer roller 62. The transfer roller 62 has an axis which is parallel to the axis of the image carrier 30. The circumferential surface of the transfer roller 62 contacts the circumferential surface of the image carrier 30 to form a transfer region (a nip region). The transfer roller 62 applies an electric field (a transfer electric field) to the sheet P conveyed to the transfer region so that the toner image formed on the surface of the image carrier 30 is electrically transferred to the sheet P. The toner image is transferred to the sheet P conveyed to the transfer region by the action of the transfer roller 62.

The cleaning device 70 collects residual toner (or untransferred toner) remaining on the image carrier 30 after the toner image formed on the image carrier 30 is transferred to the sheet P. The cleaning device 70 includes a blade 71 and a collecting auger (screw conveyor) 73. In an example, the collecting auger 73 is accommodated in a conveying path 76 formed in a casing 75, The blade 71 removes the residual toner from the outer circumferential surface by scraping off the toner (the residual or untransferred toner) remaining on the outer circumferential surface of the image carrier 30. The blade 71 is fixed to the casing 75 so as to contact the outer circumferential surface of the image carrier 30.

The scraped residual toner (or untransferred toner) is accommodated in the casing 75. The collecting auger 73 rotates about an axis along the Y direction so as to convey the residual toner accommodated in the casing 75 in the Y direction. The collecting auger 73 is rotationally driven by the driving device responsive to the control signal from the control device.

The fixing device 80 conveys the sheet P to pass through a fixing nip region for heating and pressing the sheet so that the toner image transferred from the image carrier 30 to the sheet P is fixed to the sheet P. The fixing device 80 includes a heating roller 82 which heats the sheet P and a pressing roller 84 which is rotationally driven while pressing against the heating roller 82. The heating roller 82 and the pressing roller 84 are formed in a cylindrical shape and the heating roller 82 has a heat source such as a halogen lamp provided therein. The fixing nip region is formed between the heating roller 82 and the pressing roller 84.

The discharge device 90 includes discharge rollers 92 and 94 which discharge the sheet P having the toner image fixed thereto by the fixing device 80 to the outside of the apparatus.

An example printing process using the example imaging apparatus 1. When an image signal of a target recording image is input to the imaging apparatus 1, the control device of the imaging apparatus 1 rotates the pickup roller 11 so that the sheets P stacked on the cassette K are picked up and conveyed. Then, the surface of the image carrier 30 is uniformly charged to a predetermined potential by the charging roller 32 (a charging operation), Subsequently, the exposure device 40 irradiates a laser beam to the surface of the image carrier 30 based on the received image signal so that an electrostatic latent image is formed on the surface of the image carrier 30 (an exposure operation).

The developing device 50 develops the electrostatic latent image formed on the image carrier 30 so that a toner image is formed on the surface of the image carrier 30 (a developing operation). The formed toner image is transferred from the image carrier 30 to the sheet P in a transfer region in which the image carrier 30 faces the transfer roller 62.

The sheet P to which the toner image is transferred is conveyed to the fixing device 80. Then, the fixing device 80 melts and fixes the toner image to the sheet P when the sheet P passes through the fixing nip region (a fixing operation). The discharge device 90, then discharges the sheet P to the outside of the imaging apparatus 1.

With reference to FIGS. 2 to 7, the example toner cartridge 100 is used to supply a toner to the developing device 50 of the imaging apparatus 1. Further, the toner cartridge 100 can receive the residual toner discharged from the cleaning device 70 as recycled toner (e.g.; excess toner or residual toner) to be reused.

Figure 2:
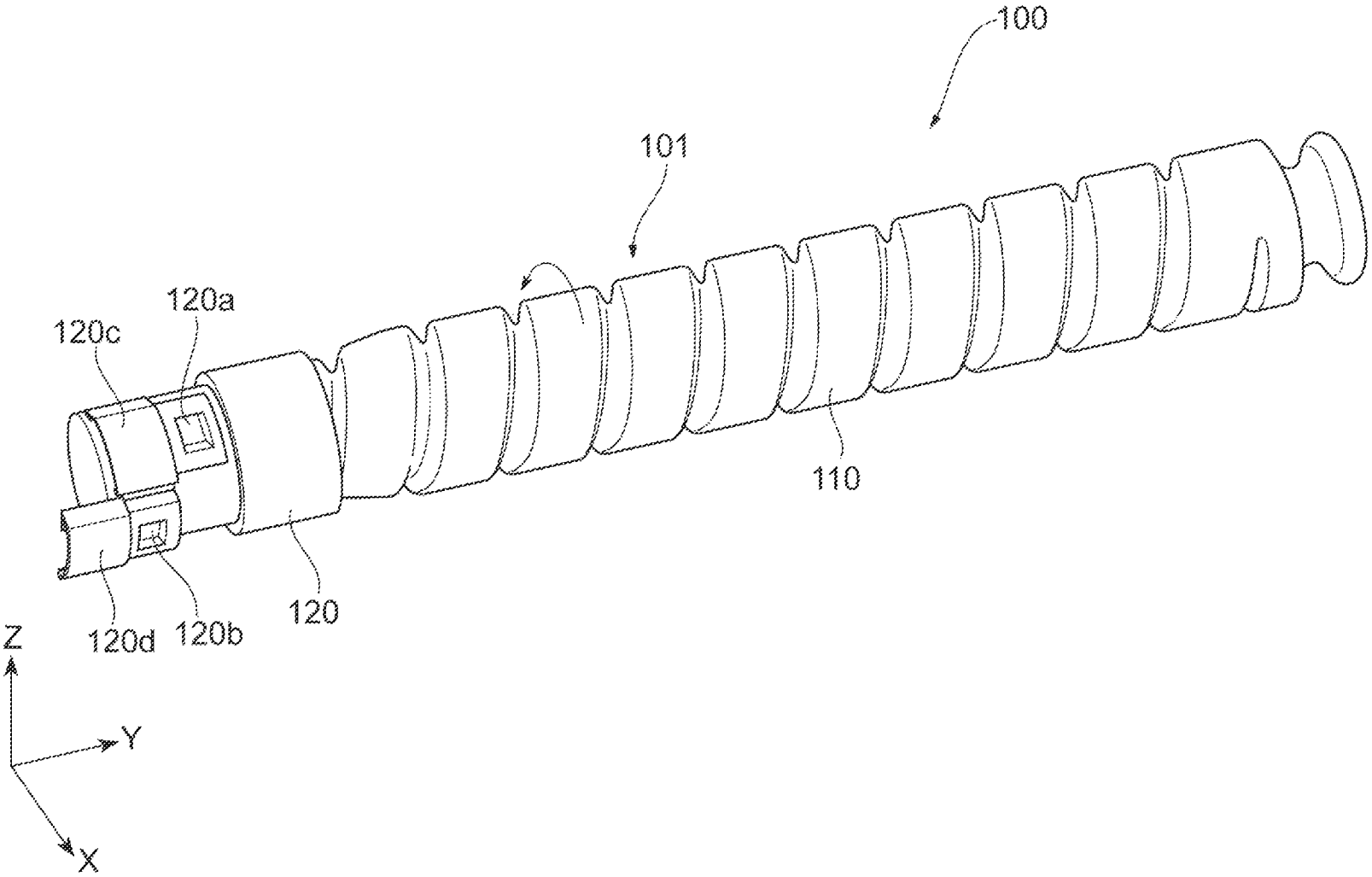
FIG. 2 is a perspective view of an example toner cartridge.

The example toner cartridge 100 is replaceable and is loaded into the cartridge compartment 20 formed in the imaging apparatus 1. With reference to FIG. 2, the example toner cartridge 100 includes a housing 101 to accommodate toner. The housing 101 extends in a longitudinal direction (the Y direction in FIG. 2). In some examples, an inlet port 120*a* and an outlet port 120*b* are formed in the housing 101. The inlet port 120*a* and the outlet port 120*b* are located at one end of the housing 101 in the longitudinal direction. The inlet port 120*a* and the outlet port 120*b* are offset from each other in the longitudinal direction. The outlet port 120*b* is an opening for supplying a toner to the developing device 50. The inlet port 120*a* is an opening for receiving residual toner (an untransferred toner) removed from the image carrier 30 into the housing 101, as a recycled toner to be reused. The inlet port 120*a* is formed in the housing 101 so as to be separated from the outlet port 120*b*.

Figure 3:
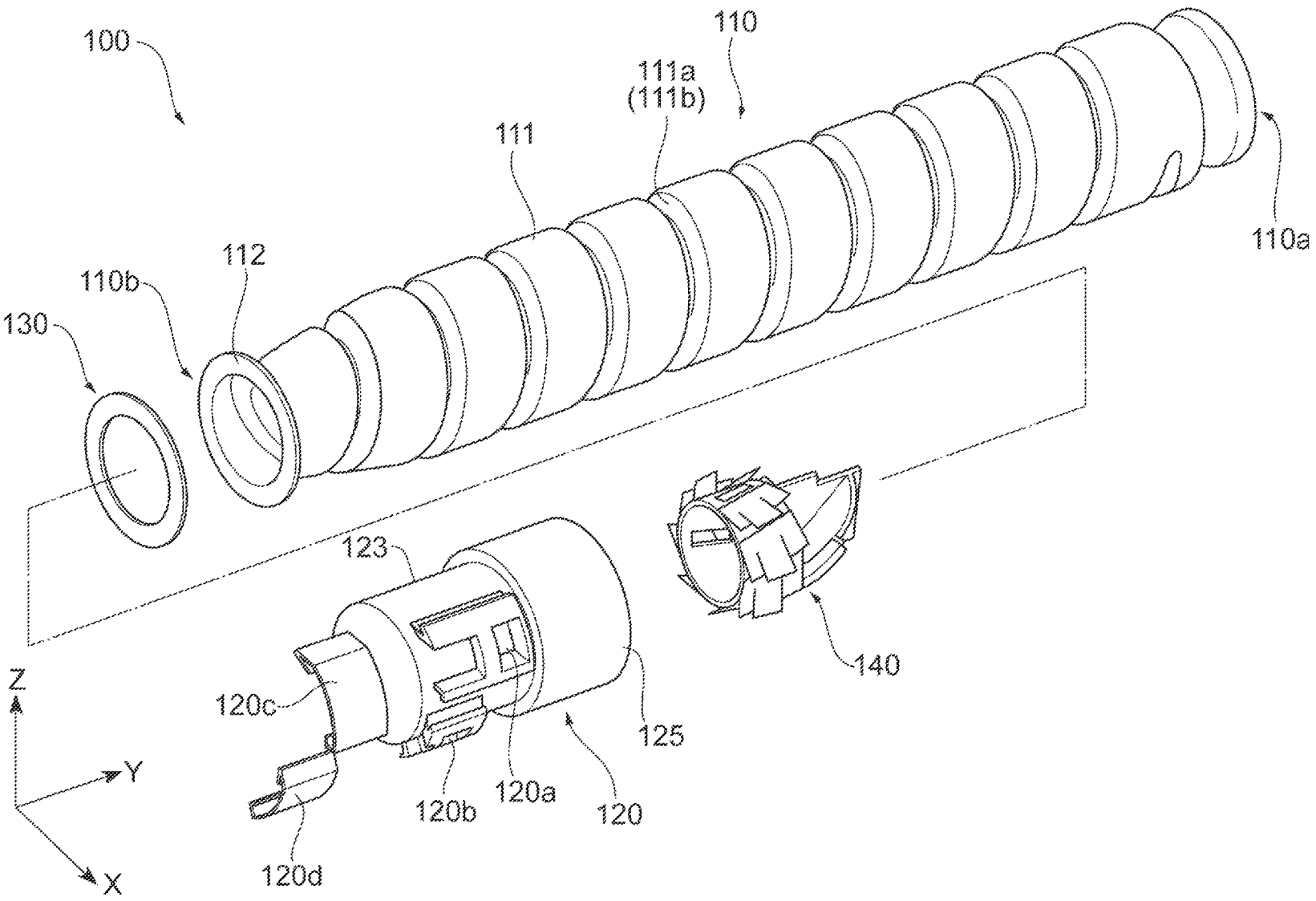
FIG. 3 is an exploded perspective view of an example toner cartridge.

With reference to FIG. 3, the housing 101 includes a toner container 110, a cap member 120, and a conveying member 140. The toner container 110 is formed in a substantially cylindrical shape which extends in a longitudinal direction (the Y direction) and includes a closed end 110*a*, an opening end 110*b* opposite the closed end 110*a*, and a circumferential wall 111 connecting the closed end 110*a* and the opening end 110*b*. The opening end 110*b* of the toner container 110 is provided with a flange 112 having an annular plate shape and surrounding an opening.

The circumferential wall 111 is provided with a spiral groove 111*a* which extends from the closed end 110*a* to the opening end 110*b*, Accordingly, the inner circumferential surface of the circumferential wall 111 includes a convex portion 111*b* continuous in a spiral shape and formed by the groove 111*a*. The toner container 110 may rotate about an axis (a rotational axis) along the longitudinal direction, to move the toner accommodated in the toner container 110 along the axial direction by the action of the convex portion 111*b*, The toner container 110 may rotate in a direction indicated by the rotation arrow in FIG. 2, to urge the toner to move from the closed end 110*a* toward the opening end 110*b*. Additionally, in an example, a driving device for rotating the toner container 110 may be provided in the cartridge compartment 20 of the imaging apparatus 1. For example, the driving device may engage with the closed end 110*a* so as to rotate the toner container 110.

Figure 4:
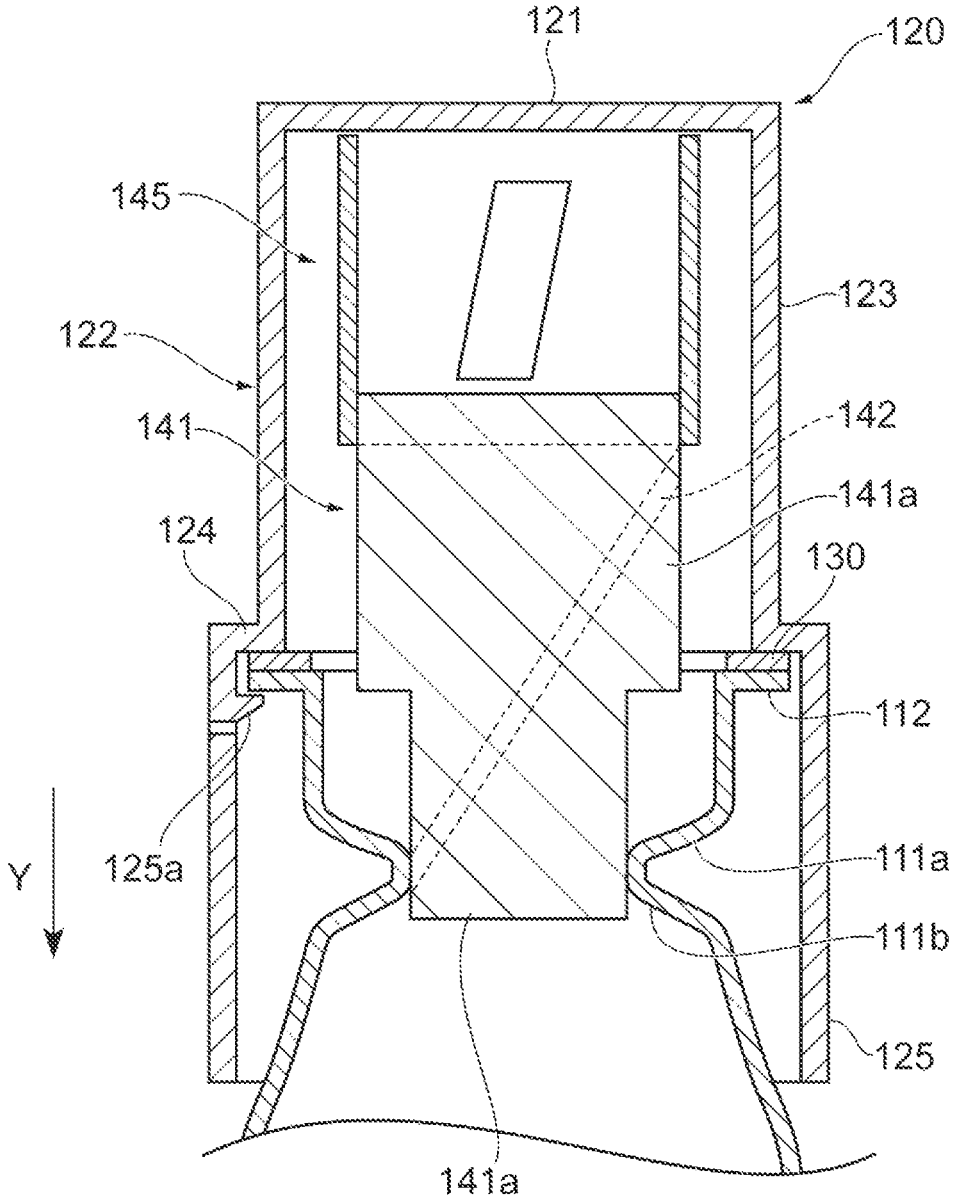
FIG. 4 is a cross-sectional view of a portion of an example of the toner cartridge.

With further reference to FIG. 4, the example cap member 120 is a member that covers the opening end 110*b* of the toner container 110. the cap member 120 is schematically illustrated in FIG. 4, with a first paddle and a second paddle of the conveying member being omitted. The cap member

120 includes a closing wall 121 which forms one end in the longitudinal direction (the Y direction) and a peripheral wall, e.g., a circumferential wall 122, which extends from the closing wall 121 to the opposite end in the longitudinal direction. In the example cap member 120, the closing wall 121 is formed in a circular plate shape. The circumferential wall 122 includes a base end wall 123 which is close to the closing wall 121 and a front end wall 125 which is distal to the closing wall 121 in relation to the base end wall 123. The base end wall 123 and the front end wall 125 of the circumferential wall 122 are formed in a cylindrical shape. The inner diameter of the front end wall 125 is larger than the inner diameter of the base end wall 123 and the outer diameter of the flange 112. The inner diameter of the base end wall 123 is smaller than the outer diameter of the flange 112. The base end wall 123 and the front end wall 125 are connected to each other by a step portion 124 having a annular plate shape that is oriented parallel to the closing wall 121.

The cap member 120 engages with the flange 112 of the toner container 110, for example, via a plurality of engagement claws 125*a* formed in the circumferential direction. An engagement claw 125*a* of an example is formed at a position separated from the step portion 124 in the inner circumferential surface of the front end wall 125 of the cap member 120. In a state in which the cap member 120 engages with the toner container 110, a ring member 130 having an annular plate shape is disposed between the step portion 124 of the cap member 120 and the flange 112 of the toner container 110.

The outer diameter of the ring member 130 is smaller than the inner diameter of the front end wall 125 of the circumferential wall 122 and is larger than the inner diameter of the base end wall 123. The inner diameter of the ring member 130 may be substantially the same as, for example, the inner diameter of the flange 112. The ring member 130 adheres to the flange 112 via an adhesive material such as double-sided adhesive tape and adhesive. The ring member 130 is formed of an elastic member such as a sponge made of urethane resin. In a state in which the cap member 120 engages with the toner container 110, the ring member 130 is compressed in the axial direction by the step portion 124 and the flange 112. For example, the cap member 120 may rotatably support the toner container 110 while sealing the opening end 110*b* of the toner container 110.

In an example, the inlet port 120*a* and the outlet port 120*b* are formed in the base end wall 123 of the cap member 120 (cf. FIG. 3), The outlet port 120*b* is provided at a position close to the closing wall 121 in relation to the inlet port 120*a*. In some examples, the outlet port 120*b* is provided closer to the closing wall 121 in relation to the center of the base end wall 123 in the longitudinal direction (the Y direction), and the inlet port 120*a* is provided closer to the front end wall 125 in relation to the center of the base end wall 123 in the longitudinal direction. In addition, the inlet port 120*a* is offset from the outlet port 120*b* in the circumferential direction. In some examples, an angular offset between the inlet port 120*a* and the outlet port 120*b* in the circumferential direction may be approximately 90° or less. In some examples, the inlet port 120*a* and the outlet port 120*b* are formed in a substantially rectangular shape.

The inlet port 120*a* is provided with a shutter 120*c*, The shutter 120*c* is formed to be larger than the inlet port 120*a* and slides in the longitudinal direction with respect to the inlet port 120*a* so as to open and close the inlet port 120*a*. Similarly, the outlet port 120*b* is provided with a shutter 120*d*. The shutter 120*d* is formed to be larger than the outlet port 120*b* and slides in the longitudinal direction so as to open and close the outlet port 120*b*. The shutters 120*c* and 120*d* are illustrated in an opened configuration in FIG. 2.

With reference to FIGS. 4 to 7, the conveying member 140 conveys the toner having been conveyed to the opening end 110*b* of the toner container 110, to the closing wall 121 of the cap member 120 while mixing the toner. The conveying member 140 extends in a range including (to align with) at least a gap between the inlet port 120*a* and the outlet port 120*b* in the axial direction (the Y direction). The conveying member 140 includes a first portion 141 having a plate shape and a second portion 145 having a cylindrical shape. In some examples, the first portion 141 includes a narrow portion 141*b* having a smaller size in the width direction intersecting the axial direction and a wide portion 141*a* having a larger size in the width direction relative to the narrow portion 141*b*. In the width direction, the center positions of the narrow portion 141*b* and the wide portion 141*a* match each other. In an example, the narrow portion 141*b* and the wide portion 141*a* have a rectangular shape. The size of the width of the wide portion 141*a* is set to be equal to or less than, for example, the size of the inner diameter of the flange 112. Additionally, the size of the width of the wide portion 141*a* may be larger than the size of the inner diameter of the flange 112.

The narrow portion 141*b* may be sized so that the narrow portion can be inserted from the opening end 110*b* of the toner container 110 into the inner space of the toner container 110. In some examples, the size of the width of the narrow portion 141*b* may be equal to or less than a gap formed between the convex portions (or the inward protrusions) 111*b* that face each other near the opening of the toner container 110. In the example illustrated in the drawings, the narrow portion 141*b* is fixed between the convex portions 111*b* facing each other, to drive the conveying member 140 into rotation together with the toner container 110. That is, when the toner container 110 rotates, the conveying member 140 also rotates. A boundary position between the wide portion 141*a* and the narrow portion 141*b* in the axial direction may coincide, for example, with the position of the flange 112.

The first portion 141 may have a plate shape and include a first flat surface and a second flat surface opposite the first flat surface. Each of the first and second flat surfaces may include a conveying paddle 142 (cf. FIGS. 5 and 6). In some examples, the conveying paddle 142 is erected on the first portion 141 so as to be orthogonal to the first and second flat surfaces of the first portion 141. The conveying paddle 142 is formed so that the front end side in the axial direction is inclined toward the rear side of the toner container in the rotation direction when the toner is conveyed. Additionally, the front end side of the axial direction indicates the side of the closing wall 121 in the Y direction. Each conveying paddle 142 is formed in a plate shape having a substantially semi-elliptical shape. Accordingly, the pair of conveying paddles 142 has a substantially circular shape as viewed from the axial direction (cf. FIG. 6).

Figure 5:
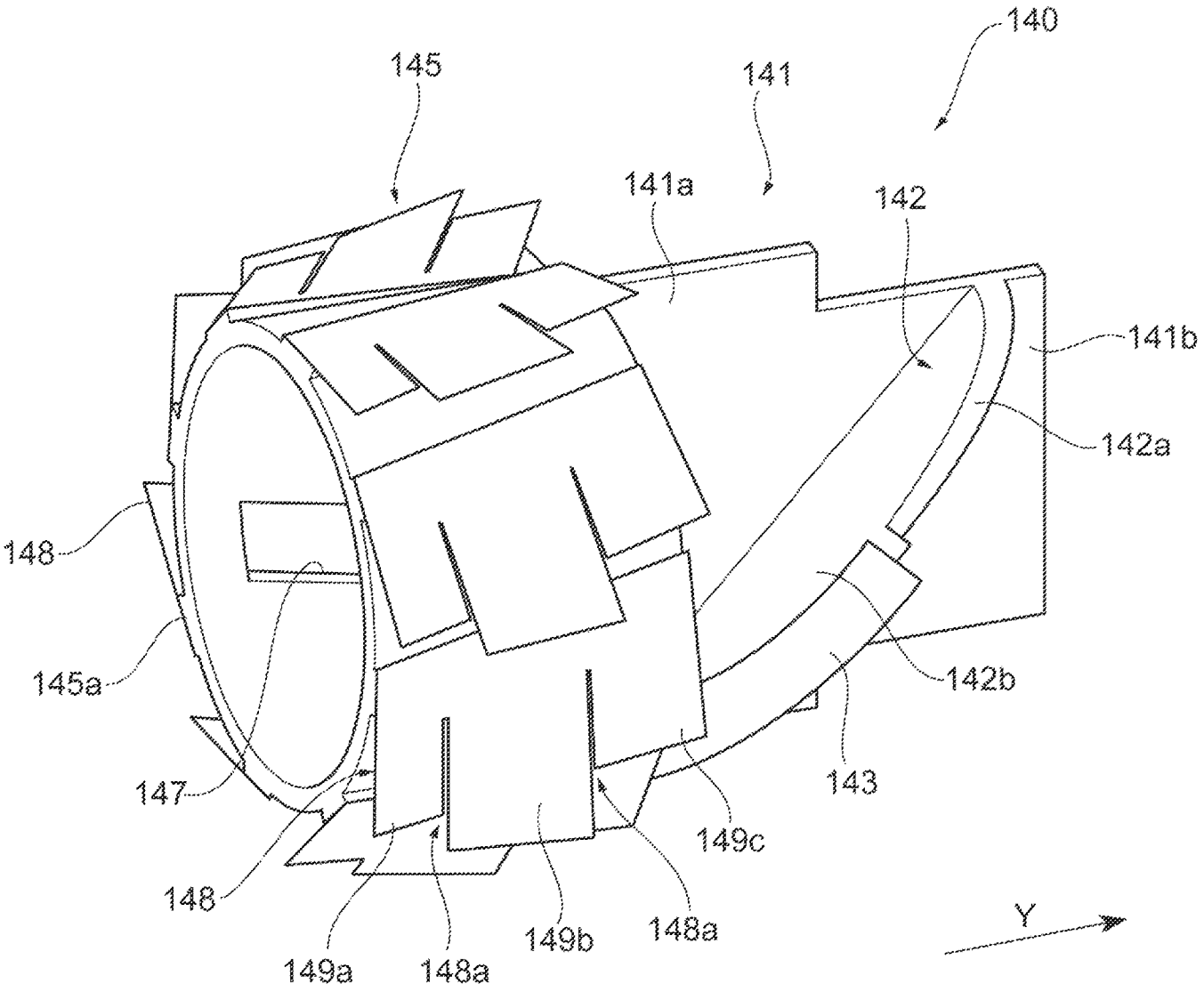
FIG. 5 is a perspective view of a conveying member of the example toner cartridge.
Figure 6:
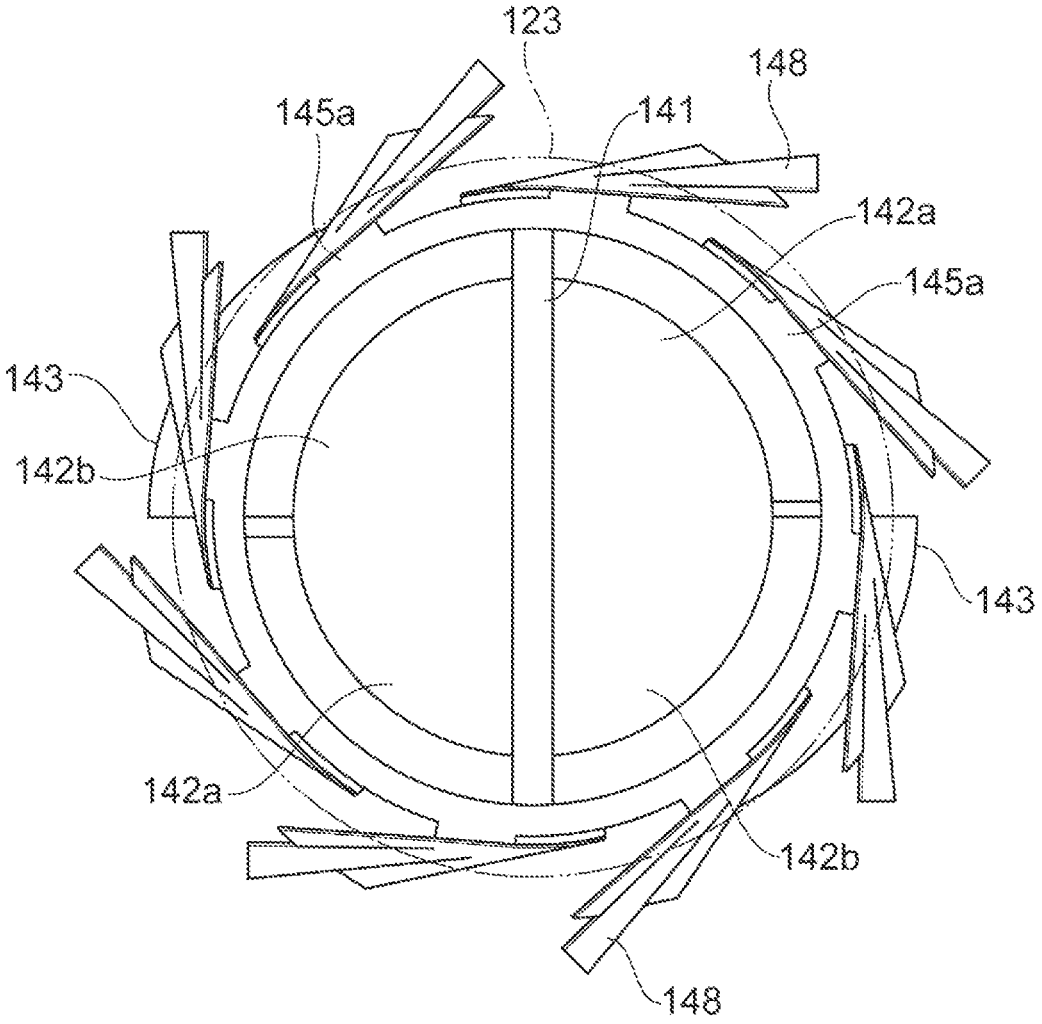
FIG. 6 is a side view of the conveying member of the example toner cartridge (as viewed from an axial direction).

With reference to FIGS. 5 and 6, the conveying paddle 142 is formed from the narrow portion 141*b* to the wide portion 141*a* in the axial direction. In some examples, a portion (a small diameter portion 142*a*) erected from the narrow portion 141*b* in the conveying paddle 142 is formed in a quarter elliptical shape having a short diameter (radius of minor axis) that is about half the width of the narrow portion 141*b*. Further, a portion (a large diameter portion 142*b*) erected from the wide portion 141*a* in the conveying paddle 142 is formed in a quarter elliptical shape having a short diameter that is about half the width of the wide portion 141*a*. The small diameter portion 142*a* is inserted into the opening of the toner container 110 and has a function of conveying the toner in the toner container 110 from the opening to the outside.

The large diameter portion 142*b* is provided with the first paddle 143. The first paddle 143 is formed in an arc shape along the circumferential edge of the large diameter portion 142*b* and is provided in the circumferential edge of the large diameter portion 142*b*. In a state in which the toner cartridge 100 is assembled, the first paddle 143 may contact the inner surface of the base end wall 123 of the cap member 120. The first paddle 143 is formed by, for example, an elastic film including urethane rubber or the like.

The second portion 145 may extend continuously from the wide portion 141*a* of the first portion 141. The second portion 145 has a cylindrical shape and the inner diameter of the second portion 145 is substantially the same as the width of the wide portion 141*a* of the first portion 141, so that a part of the wide portion 141*a* of the first portion 141 is inserted into the inner space of the second portion 145 (cf. FIG. 4). The outer circumferential surface of the second portion 145 is provided with a plurality of second paddles 148. In some examples, eight second paddles 148 are arranged at substantially equal distances along the circumferential direction (cf. FIG. 6). For example, the second paddle 148 may be an elastic film formed of polyethylene terephthalate (PET) resin and adheres to a pedestal (or protruding step) 145*a* that protrudes from the circumferential surface of the second portion 145.

The pedestal 145*a* is inclined radially outwardly toward the rear side (e.g., the upstream side) in the rotation direction when viewed from the axial direction. Accordingly, a rear side of the second paddle 148 in the rotation direction is spaced away from the outer circumferential surface of the second portion 145. The second paddle 148 may contact the inner surface of the base end wall 123 of the cap member 120. Further, the pedestal 145*a* is formed so that the front end side in the axial direction is inclined toward the rear side of the toner container 110 in the rotation direction when the toner is conveyed. Accordingly, the second paddle 148 is arranged so that the front end side in the axial direction is inclined toward the rear side of the rotation direction.

In some examples, the second portion 145 is provided with a plurality of window portions 147, which communicate the inside with the outside of the second portion 145 (cf. FIG. 5). The window portions 147 are formed between pedestals 145*a* in the circumferential direction. In some examples, eight pedestals 145*a* are formed and four window portions 147 are formed at the same interval in the circumferential direction. The number of the window portions may vary. For example, there may be three or less window portions in some examples, or five or more window portions in other examples.

Figure 7:
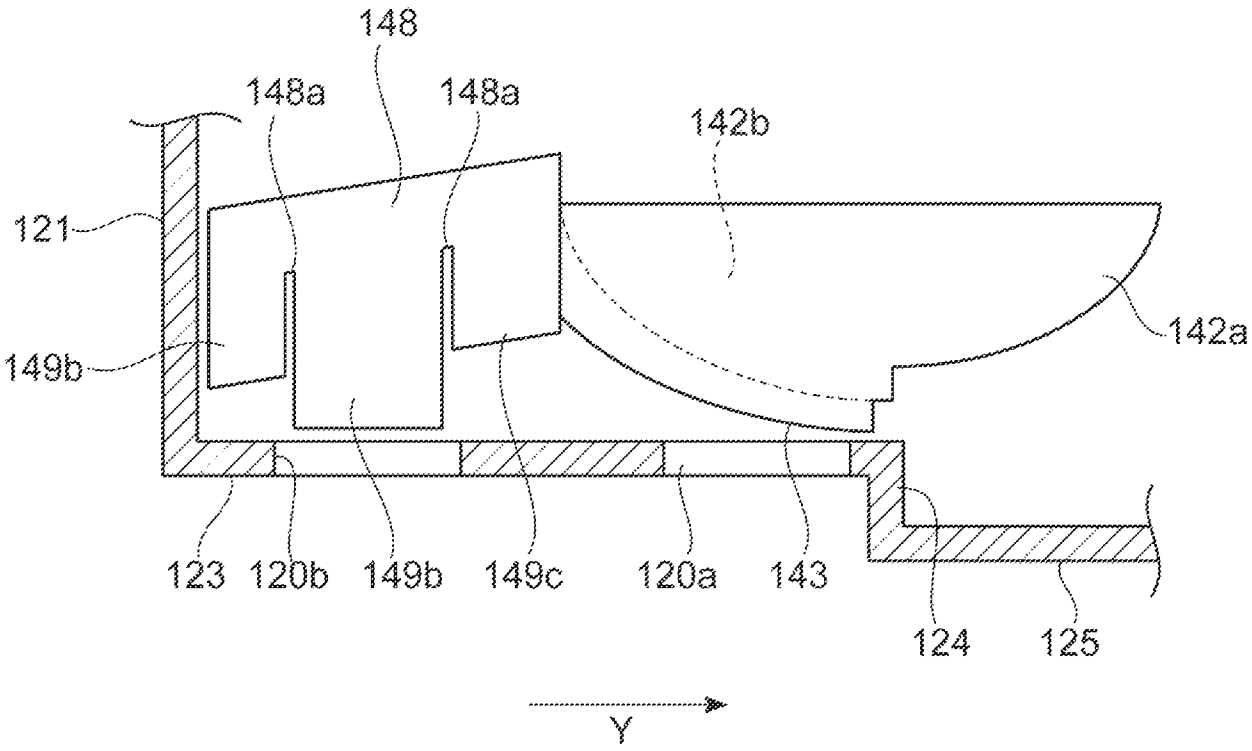
FIG. 7 is a schematic cross-section view of an example cap member, taken in a longitudinal direction, illustrating a positional relationship of first and second paddles of an example conveying member and inlet and outlet ports of the cap member.

With reference to FIG. 7, the first paddle 143 is positioned to align with the inlet port 120*a* in the axial direction so as to mix the fresh toner in the toner container 110 with the recycled toner (excess or residual toner to be reused) supplied from the inlet port 120*a*. The second paddle 148 is positioned to align with the outlet port 120*b* so as to convey the mixed toner to the outlet port 120*b*. Two notches 148*a* are formed at the free end side of the second paddle 148 along the rotation direction. The two notches 148*a* are spaced apart from each other in the axial direction. Accordingly, the free end of the second paddle 148 is divided into three sections 149*a*, 149*b*, and 149*c* in the axial direction, including a center section 149*c* and two side sections 149*a* and 149*b*.

In an example, the center section 149*b* is longer than the side sections 149*a* and 149*b*, such that the center section 149*b* has a length from the base end that is greater than the length of the side sections 149*a* and 149*c*. In the other sections 149*a* and 149*c*, the front end side of the axial direction is inclined backward in the rotation direction at the rear side of the rotation direction similarly to the pedestal 145*a*. The rear side of the center section 149*b* is formed along the axial direction in the rotation direction. When the toner container 110 and the conveying member 140 rotate with respect to the cap member 120, the center section 148*b* can be pushed out from the outlet port 120*b*.

The toner cartridge 100 which is loaded into the cartridge compartment 20 receives the recycled toner from the cleaning device 70 and discharges the mixed toner obtained by mixing the fresh toner with the recycled toner to the developing device 50.

Figure 8:
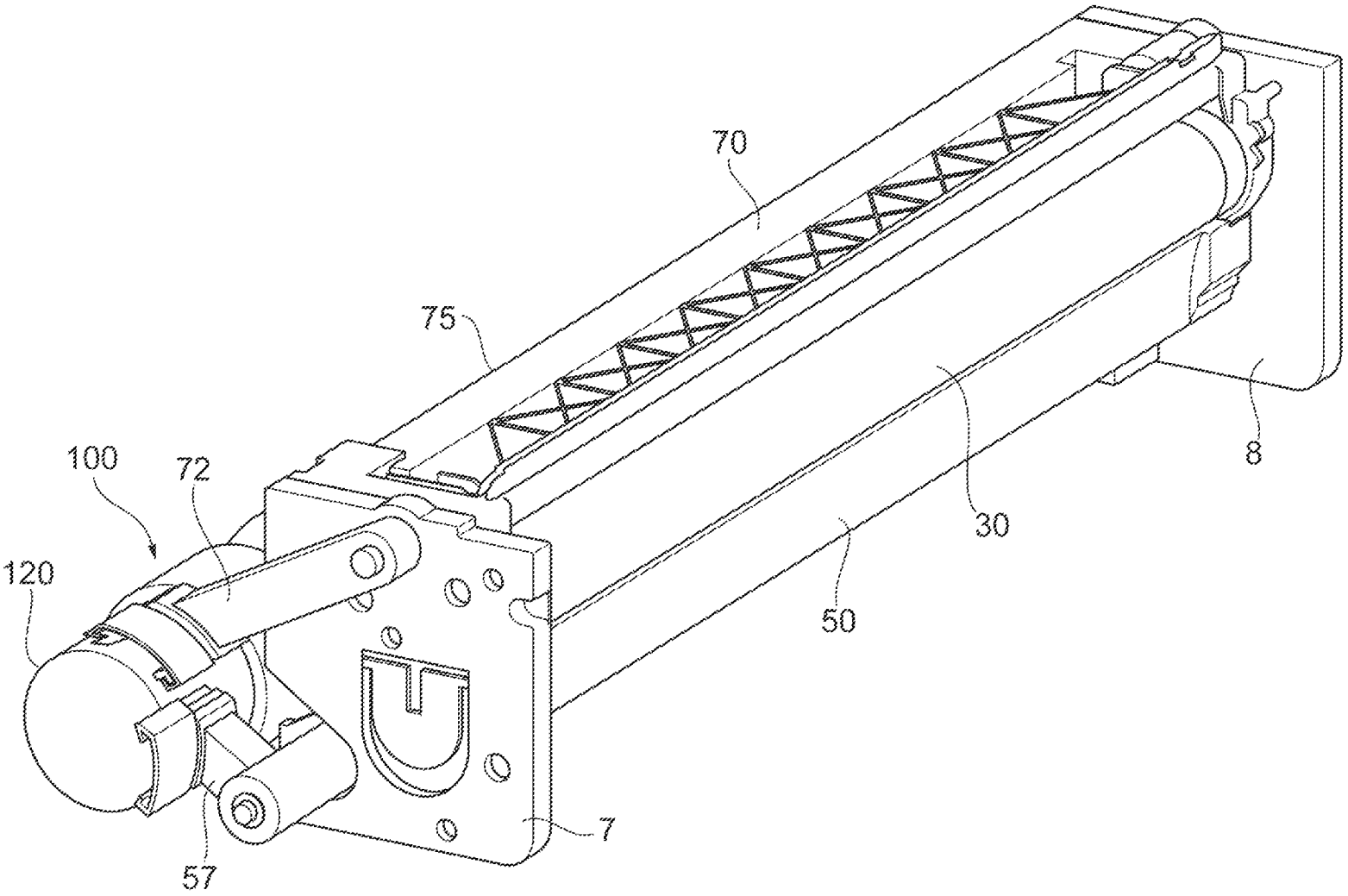
FIG. 8 is a perspective view illustrating an example arrangement of a toner cartridge, a cleaning device, an image carrier, and a developing device.
Figure 9:
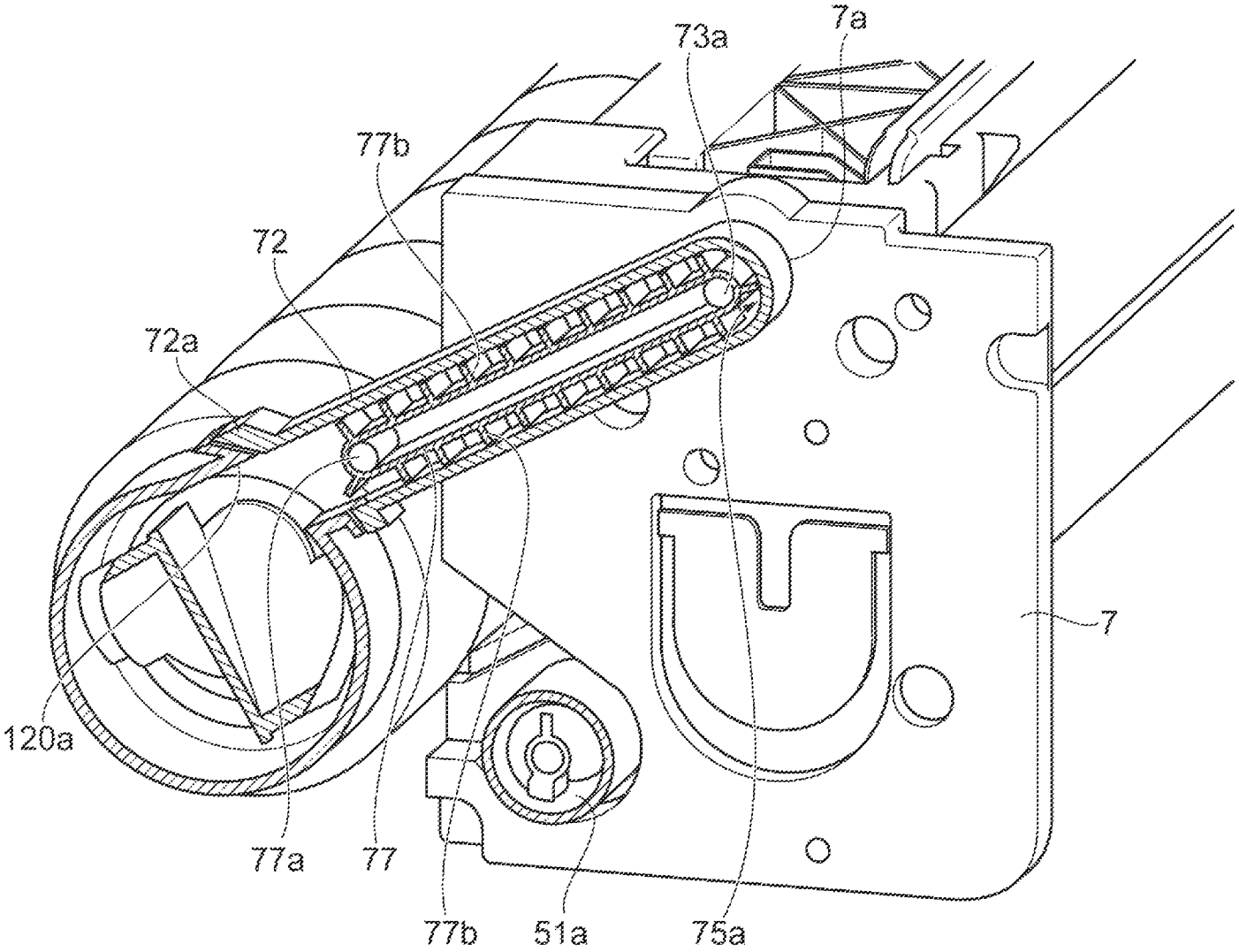
FIG. 9 is a partial perspective view of the arrangement of FIG. 8, illustrating a cross-section of a recycled toner path connected to the cleaning device and of the toner cartridge.
Figure 10:
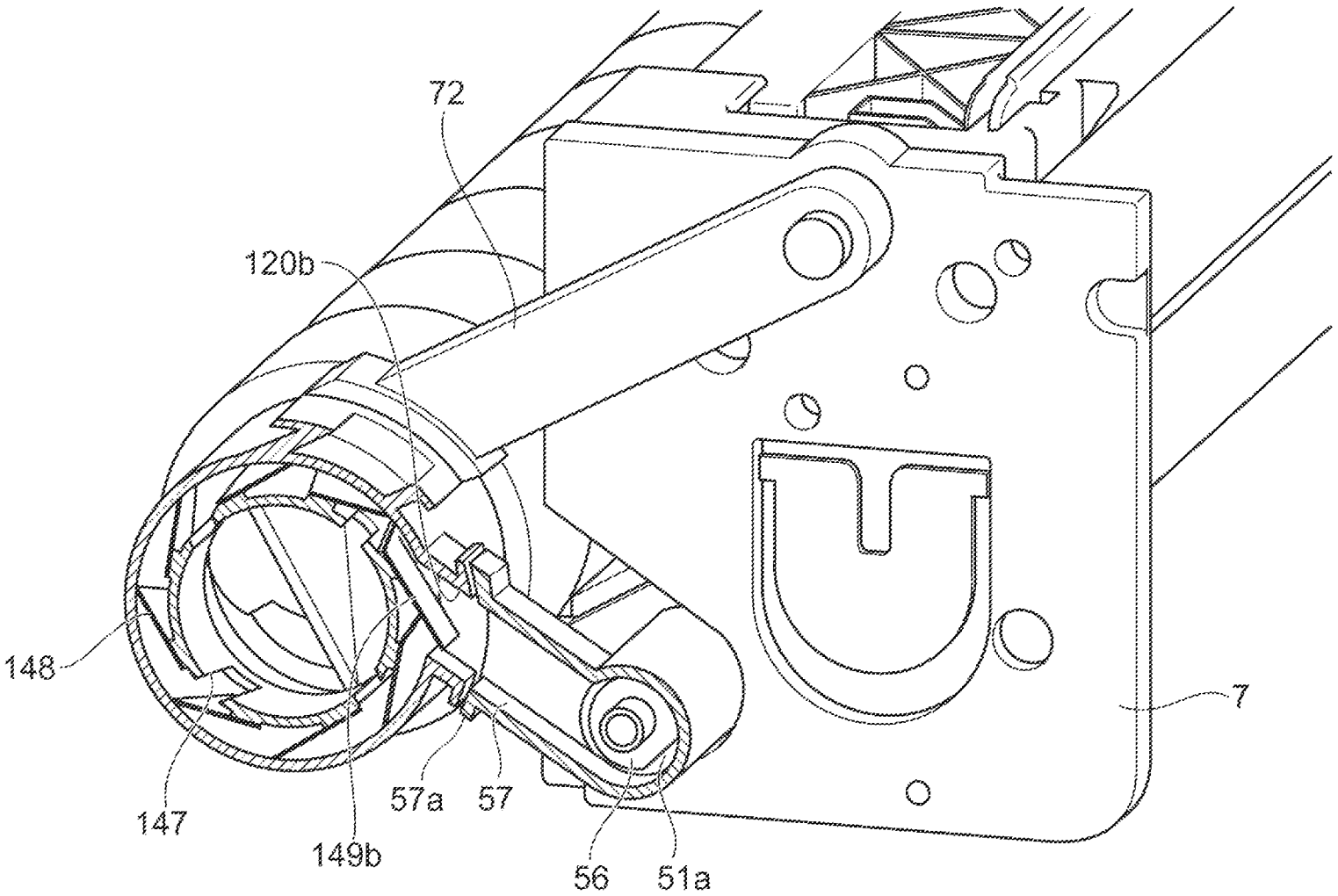
FIG. 10 is a partial perspective view of the arrangement of FIG. 8, illustrating a cross-section of a toner supply path connected to the developing device, and of the toner cartridge.

FIG. 8 is a perspective view illustrating the toner cartridge 100, the cleaning device 70, the image carrier 30, and the developing device 50. FIG. 9 is a cross-sectional perspective view for describing the recycled toner path connected to the cleaning device. In FIG. 9, each component is cut at the position of the recycled toner path. FIG. 10 is a cross-sectional perspective view for describing the toner supply path connected to the developing device. In FIG. 10, each component is cut at the position of the toner supply path. With reference to FIG. 8, the cleaning device 70, the image carrier 30, and the developing device 50 may be supported by the pair of side plates 7 and 8 to be positioned.

A recycled toner path 72 having a substantially elongated shape is connected to the cleaning device 70. The recycled toner path 72 conveys the recycled toner collected by the cleaning device 70 to the inlet port 120*a* of the toner cartridge 100. The inlet port 120*a* is located lower than the cleaning device in the vertical direction. Accordingly, the recycled toner path 72 is inclined from a first end toward the cleaning device 70 to a second end connected with the inlet port 120*a*, such that the second end is lower than the first end, in the vertical direction. The recycled toner path 72 in an example is connected to one end of the conveying path 76 (cf. FIG. 1) accommodating the collecting auger 73, In some examples, an outlet port 75*a* is formed in the casing 75 constituting the cleaning device 70. The outlet port 75*a* is located at a downstream end of the conveying path 76 and communicates the inside with the outside of the casing 75. The side plate 7 is provided with an opening 7*a* formed at a position corresponding to the outlet port 75*a* and the inlet of the recycled toner path 72 is connected to the opening 74*a* (cf. FIG. 9). A rotation shaft 73*a* of the collecting auger 73 protrudes from the opening 7*a* of the side plate 7 into the recycled toner path 72.

The inner space of the recycled toner path 72 is provided with a conveyor belt 77 which conveys the recycled toner. The conveyor belt 77 is suspended between a fixed shaft 77*a* and the rotation shaft 73*a* of the collecting auger 73 in the recycled toner path 72. For example, the conveyor belt 77 may be driven in accordance with the rotation of the collecting auger 73. The fixed shaft 77*a* is formed in the vicinity of the outlet of the recycled toner path 72. A plurality of fins (upright portions) 77*b* are formed at the same interval in the circumferential direction of the conveyor belt 77. When the conveyor belt 77 is rotationally driven in accordance with the driving of the collecting auger 73, the fin 77*b* moves while contacting the inner surface of the recycled toner path 72.

The outlet of the recycled toner path 72 is connected to the inlet port 120*a* of the toner cartridge 100 that is loaded into the cartridge compartment 20. In an example, the outlet of the recycled toner path 72 is provided with a collar portion 72*a*. When the toner cartridge 100 is loaded into the cartridge compartment 20, the collar portion 72*a* slides open the shutter 120*c* provided in the inlet port 120*a* of the toner cartridge 100 and is connected to the inlet port 120*a* so as to cover or overlap the inlet port 120*a*.

The developing device 50 is provided with a cylindrical toner supply path 57. The toner supply path 57 is a portion which receives the toner discharged from the outlet port 120*b* of the toner cartridge 100 and introduces the toner into the developing device 50. The inlet of the toner supply path 57 is connected to the outlet port 120*b* of the toner cartridge 100 that is loaded into the cartridge compartment 20. The toner supply path 57 is inclined so that a connection side to the outlet port 120*b* is directed upward. For example, the toner supply path 57 may be inclined from a first end that is connected to the outlet port 120*b* to a second end that is connected to the developing device, such that the second end is positioned lower than the first end, in the vertical direction. In an example, the inlet of the toner supply path 57 is provided with a collar portion 57*a*. When the toner cartridge 100 is loaded into the cartridge compartment 20, the collar portion 57*a* slides open the shutter 120*d* provided in the outlet port 120*b* of the toner cartridge 100 and is connected to the outlet port 120*b* so as to cover (or overlap with) the outlet port 120*b*. The outlet of the toner supply path 57 communicates with the conveying path 51*a* in which the mixing auger 56 is disposed. In some examples, the outlet of the toner supply path 57 communicates with the upstream end of the conveying path 51*a*.

An example operation of supplying and circulating the toner will be described. As described in the examples above, the developing device 50 develops the electrostatic latent image formed on the image carrier 30 so that the toner image is formed on the surface of the image carrier 30 (a developing operation). At this time, the developing device 50 supplies the toner to the image carrier 30. After the toner image formed on the image carrier 30 is transferred to the sheet P, the residual toner (or untransferred toner) remaining on the image carrier 30 is collected by the cleaning device 70. The collected residual toner is conveyed by the collecting auger 73 to the inlet of the recycled toner path 72 as the recycled toner to be reused. The conveyed recycled toner is conveyed by the conveyor belt 77 in the recycled toner path 72 and is supplied into the toner cartridge 100, via the inlet port 120*a* of the toner cartridge 100.

When the toner is supplied from the toner cartridge 100 to the developing device 50, the toner container 110 is rotated by the driving device. When the toner container 110 rotates, the fresh toner in the toner container 110 is conveyed toward the opening end 110*b* by the action of the convex portion 111*b*. The fresh toner is discharged to the outside of the toner container 110 by the action of the small diameter portion 142*a* of the conveying member 140. The discharged fresh toner is conveyed to the front end side in the Y direction while being mixed by the action of the large diameter portion 142*b* and the first paddle 143, Δt this time, the recycled toner supplied from the inlet port 120*a* is also conveyed to the front end side while being mixed by the action of the large diameter portion 142*b* and the first paddle 143. Accordingly; the fresh toner discharged from the toner container 110 and the recycled toner input from the inlet port 120*a* are mixed by the action of the large diameter portion 142*b* and the first paddle 143 to form the mixed toner, and the mixed toner is conveyed to the front end side. The conveyed mixed toner is discharged from the outlet port 120*b* while being further mixed by the second paddle 148. At this time, the mixed toner conveyed into the second portion 145 can be moved to the outer circumferential side of the second portion 145 through the window portion 147. The discharged mixed toner is supplied from the toner supply path 57 into the developing device 50. The supplied mixed toner is used in the developing operation as described further above.

As described above, in the example toner cartridge 100, the housing 101 accommodating the fresh toner is provided with the outlet port 120*b* and the inlet port 120*a*, and the fresh toner is mixed with the recycled toner in the housing 101 to produce mixed toner. Accordingly; a same device may be used for mixing the fresh toner and the recycled toner, so as to reduce the size and complexity of the imaging apparatus.

Further, the housing 101 includes the toner container 110 with the closed end 110*a* and the opening end 110*b* opposite the closed end 110*a*, and the cap member 120 covering the opening end 110*b* of the toner container 110. The inlet port 120*a* and the outlet port 120*b* are formed in the cap member 120. In an example, the cap member 120 includes the closed wall 121 which forms one end in the longitudinal direction (the Y direction) and the circumferential wall 122 which extends from the closed wall 121 to the other end side of the longitudinal direction and the inlet port 120*a* and the outlet port 120*b* are formed in the circumferential wall 122. Accordingly, since the recycled toner is mixed with the fresh toner discharged from the toner container 110, the ratio between the fresh toner and the recycled toner in the mixed toner remains more stable.

Further, the example toner cartridge 100 includes the conveying member 140 located between the inlet port 120*a* and the outlet port 120*b* inside the cap member 120, to more easily mix the toner via the conveying member 140, in a range of conveyance of the recycled toner input from the inlet port 120*a* to the outlet port 120*b*.

Further, the toner container 110 and the conveying member 140 relatively rotate with respect to the cap member 120. In this configuration, the toner container 110 can be rotated while the cap member 120 is fixed in the imaging apparatus 1. Accordingly, the alignment and/or connection of the inlet port 120*a* with the recycled toner path 72, and of the outlet port 120*b* with the toner supply path 57 can be more easily achieved.

The first paddle 143 is positioned to align with the inlet port 120*a* so as to convey the fresh toner in the toner container 110 and to mix the conveyed fresh toner with the recycled toner that is input or supplied from the inlet port 120*a*. Further, the second paddle 148 is positioned to aligned with the outlet port 120*b* so as to convey the mixed toner to the outlet port 120*b*.

The first paddle 143 is disposed so as to contact the inner surface of the circumferential wall 122 of the cap member 120. In this configuration, the first paddle 143 can rotate with respect to the cap member 120 while contacting the inner surface of the circumferential wall 122 of the cap member 120. Since no gap is formed between the first paddle 143 and the inner surface of the circumferential wall 122, the toner is inhibited from remaining stagnant within the cap member 120.

The conveying member 140 is disposed in the opening end 110*b* of the toner container 110 from the inside and the outside of the toner container 110, to more easily convey the fresh toner in the toner container 110, from the inside of the toner container 110 to the outside through the opening end 110*b*.

The housing 101 extends in a longitudinal direction (the Y direction) and the inlet port 120*a* and the outlet port 120*b* are offset from each other in the longitudinal direction. The recycled toner supplied from the inlet port 120*a* is mixed with the fresh toner accommodated in the toner cartridge 100 until the recycled toner is conveyed to the outlet port 120*b*. In some examples, the conveying member 140 is located between the inlet port 120*a* and the outlet port 120*b* in the longitudinal direction and the conveying member 140 is configured to mix the recycled toner with the fresh toner in the housing 101, in order to more reliably mix the recycled toner with the fresh toner in the housing 101.

Further, the example imaging apparatus 1 includes the toner supply path 57 which receives the toner from the outlet port 120*b* of the toner cartridge 100 and the recycled toner path 72 which conveys the recycled toner to the inlet port 120*a* of the toner cartridge 100. The toner supply path 57 is inclined so that a connection side to the outlet port 120*b* is directed upward and the recycled toner path 72 is inclined so that a connection side to the inlet port 120*a* is directed downward, so that the toner is conveyed downward, and more easily conveyed along the path.

Further, the recycled toner path 72 includes the conveyor belt 77 which conveys the recycled toner, to suppress or inhibit the stagnation of the toner in the recycled toner path 72, Since the conveyor belt 77 includes the plurality of fins 77*b* (convex portions) erected on the surface of the conveyor belt 77, the toner can be more efficiently conveyed by the action of the fin 77*b*.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

For example, although an example in which a single toner cartridge is loaded into the example imaging apparatus 1 has been described, in some examples, a plurality of toner cartridges may be respectively loaded into a plurality of cartridge compartments formed in the imaging apparatus.

The invention claimed is:

1. A replaceable toner cartridge for an imaging apparatus including a developing device having an image carrier, the replaceable toner cartridge comprising:

a housing to accommodate toner;

an outlet port formed in the housing to supply the toner to the developing device; and an inlet port formed in the housing and spaced apart from the outlet port, to receive a residual toner removed from the image carrier of the developing device, as a recycled toner.

2. The toner cartridge according to claim 1, wherein the housing includes a toner container including a closed end and an opening end opposite the closed end, and a cap member to cover the opening end of the toner container, and wherein the inlet port and the outlet port are formed in the cap member.

3. The toner cartridge according to claim 2, wherein the toner container and the cap member extend in a longitudinal direction when the cartridge is coupled to the developing device, wherein the cap member has an end wall at a closed end in the longitudinal direction and a peripheral wall extending from the end wall in the longitudinal direction, and wherein the inlet port and the outlet port are formed in the peripheral wall.

4. The toner cartridge according to claim 3, wherein a first distance taken in the longitudinal direction between the inlet port is and the opening end of the toner container is shorter than a second distance between the outlet port and the opening end, in the longitudinal direction.

5. The toner cartridge according to claim 3, comprising:

a conveying member located in the cap member between the inlet port and the outlet port in the longitudinal direction, to convey the toner.

6. The toner cartridge according to claim 5, the toner container and the conveying member to rotate relative to the cap member.

7. The toner cartridge according to claim 6, wherein the conveying member includes:

a first paddle aligned with the inlet port to convey the toner in the toner container and to mix the toner conveyed with the recycled toner received from the inlet port, to form mixed toner; and a second paddle aligned with the outlet port to convey the mixed toner to the outlet port.

8. The toner cartridge according to claim 7, wherein the first paddle is in contact with an inner surface of the peripheral wall of the cap member.

9. The toner cartridge according to claim 5, wherein the conveying member extends from an inside of the toner container to an outside of the toner container, at the opening end of the toner container.

10. The toner cartridge according to claim 1, wherein the housing extends in a longitudinal direction, and wherein the inlet port and the outlet port of the cap member are offset from each other in the longitudinal direction, when the cap member is coupled to the housing.

11. The toner cartridge according to claim 10, comprising:

a conveying member that is located between the inlet port and the outlet port in the longitudinal direction to mix the recycled toner received from the developing device with the toner in the housing.

12. An imaging system comprising:

a cartridge compartment to accommodate a toner cartridge having an inlet port and an outlet port;

a toner supply path to receive toner from the outlet port of the toner cartridge;

a developing device to receive the toner supplied from the toner supply path;

an image carrier to form a toner image with the toner is supplied from the developing device;

a cleaning device located adjacent to the image carrier to remove a residual toner remaining on the image carrier; and a recycled toner path to convey the residual toner from the cleaning device to the inlet port of the toner cartridge, as a recycled toner.

13. The imaging system according to claim 12, wherein the toner supply path includes a first connection end to be coupled with the outlet port of the toner cartridge, wherein the toner supply path is inclined to extend upwardly toward the first connection end, and wherein the recycled toner path includes a second connection end to be coupled with the inlet port of the toner cartridge, wherein the recycled toner path is inclined to extend downwardly toward the second connection end.

14. The imaging system according to claim 12, wherein the recycled toner path includes a conveyor belt to convey the recycled toner.

15. The imaging system according to claim 14, wherein the conveyor belt includes a plurality of fins erected on a surface of the conveyor belt.

* * * * *